US006062514A

United States Patent [19]

McQuistian

[11] Patent Number: 6,062,514

[45] Date of Patent: May 16, 2000

[54] RAILWAY SWITCH CIRCUIT CONTROLLER

[75] Inventor: Kevin M. McQuistian, Westmoreland County, Pa.

[73] Assignee: Union Switch & Signal, Inc., Pittsburgh, Pa.

[21] Appl. No.: 09/120,610

[22] Filed: Jul. 22, 1998

[51] Int. Cl.[7] ..... B61L 5/00

[52] U.S. Cl. ..... 246/218; 246/219; 246/220; 246/225; 246/253

[58] Field of Search ..... 246/218, 219, 246/220, 221, 253, 223, 224, 225

[56] References Cited

U.S. PATENT DOCUMENTS

| | | | |
|---|---|---|---|
| 1,667,473 | 4/1928 | Howe | 246/253 |
| 2,747,056 | 5/1956 | Jefferson | 200/153 |
| 5,598,992 | 2/1997 | Chew | 246/253 |

*Primary Examiner*—Mark T. Le
*Assistant Examiner*—Robert J. McCarry, Jr.
*Attorney, Agent, or Firm*—David V. Radack; Eckert Seamans Cherin & Mellott LLC

[57] ABSTRACT

A railway switch circuit controller has a housing enclosing a laterally movable platform with a first and second target affixed thereupon. A first and second proximity sensor within the housing is positioned to detect the first and second target, respectively, such that the proximity sensor upon detection of the respective target may provide a signal. The platform is connected to a point detector connecting rod of a railway switch, thereby to be movable relative to the movement of the point detector connecting rod. In a first preferred embodiment, the platform may be cooperatively engaged with a rotational drive shaft that is connected to the point detector connecting rod, thereby to move laterally when the drive shaft is rotated by lateral movement of the rod. In the first preferred embodiment, the first and second proximity sensor may be fixed within the housing and the first and second target may be adjustable laterally within the platform towards and away from the other target, respectively.

26 Claims, 5 Drawing Sheets

RAILWAY SWITCH CIRCUIT CONTROLLER

BACKGROUND OF THE INVENTION

1. Field of the Invention

The present invention relates generally to railway switching devices and, more particularly, to a railway switch circuit controller for controlling a circuit associated with the railway switching device.

2. Description of the Related Art

Railway turnouts alternatively divert trains from one set of tracks to another set of tracks. A common turnout used in the industry has a switch property which includes: switch points connected to a point detector connecting rod, a switching device or machine that is connected with an operating rod to the point detector connecting rod, a frog to carry the train wheel flanges across opposing rails, and lead rails between the frog and the switch points. In operation, the operating rod transmits the operating force of the switching device to the switch points, thereby causing the switch points to move. The point detector connecting rod follows the movement of the switch points and translates the position of the switch points at all times.

A railway switch circuit controller is a device that is typically mounted to the railroad ties and is connected to the point detector connecting rod. The switch circuit controller provides a signal indicating the position of the point detector connecting rod and related switch points. The signal produced by the switch circuit controller is a vital indication, which means that the signal is considered fail-safe, that the signal need not be checked further, and that the signal may be presumed to be accurate. The signal from the controller is transmitted to a micro-processor controller to identify the position of a crank and the connected point detector connecting rod. A description of a typical railway switch circuit controller may be found in U.S. Pat. No. 5,598,992, issued in the name of Chew, which patent is assigned to the present Assignee and is hereby incorporated by reference herein.

By way of brief description, the typical railway switch circuit controller comprises various mechanical moving parts that operate together such that movement of the point detector connecting rod causes electrical contacts to be made inside a housing of the controller. As described in the above-referenced U.S. Pat. No. 5,598,992, the various mechanical moving parts include a crank arm connected to a rotatable cam shaft that has one or more cam segments that are engageable with one or more movable spring-biased followers. The followers are connected to respective movable electrical heel contacts. Additionally, a contact spring assembly is comprised of two spaced-apart fixed electrical contacts and the movable heel contact. The contact spring assembly is mounted to an insulating terminal board that is mounted within the housing. When the operating rod is thrown by the switching device to move the switch point, the translation of the operating rod and attached point detector connecting rod moves the switch points and causes the connected crank arm to rotate. When the crank arm rotates, the cam shaft rotates, causing the cams to engage the spring-biased followers, which in turn cause various movable contact springs to complete selected electrical circuits, which produce respective electrical signals. Thus, movement of the point detector connecting rod causes electrical signals to be produced by electrical contacts that are made inside of the housing of the controller.

It has been found in the harsh railroad environment that the repetitive cycling between normal and reverse positions of the switch points results in wear and tear on the movable mechanical parts within the controller housing, thereby requiring maintenance on a frequent basis. Replacement of individual mechanical parts may require too much money and maintenance personnel time to be cost-effective. Further, the plethora of such controllers on existing railway lines makes replacement of the plethora of such controllers advantageous if the existing railway switch does not require significant redesign.

Consequently, a need has been felt for providing a railway switch circuit controller which overcomes the problems of wear and tear caused by the cycling between normal and reverse positions of the switch, and also is interchangeable with the current designs of external tie-mounted railway switch circuit controllers.

SUMMARY OF THE INVENTION

It is therefore an object of the present invention to provide an improved railway switch circuit controller that provides a fail-safe indication of the position of the point detector connecting rod that is connected to the railway switch points.

It is another object of the present invention to provide a railway switch circuit controller that can survive and be dependable in the harsh environment typically found in railway systems.

It is a feature of the present invention to provide an improved railway switch circuit controller that is directly interchangeable with current designs of external railroad tie-mounted circuit controllers It is a further feature of the present invention to reduce wear and tear by incorporating proximity sensors to sense the position of a moving platform that relates to the movement of the point detector rod, thereby minimizing moving parts and related springs.

It is a further feature of the present invention to reduce wear and tear by incorporating the use of ball-bearings among certain moving parts.

Briefly described according to a preferred embodiment of the present invention (refer to FIGS. 1 and 2), a railway switch circuit controller is provided, comprising a housing with openings in opposing side surfaces thereof is mountable with lag bolts atop of a railroad tie that connects dual railroad tracks. A drive shaft is rotatably disposed through the side openings of the housing. The drive shaft is rotatable by a point detector connecting rod that is attached with a crank arm to the drive shaft, such that lateral movement of the connecting rod according to a desired position of the railway switch point rotates the drive shaft. A drive gear may be toothed and is fixedly mounted to the drive shaft, thereby to rotate therewith. Rotational movement of the drive gear is translated into lateral movement of a platform having corresponding teeth that cooperatively engage the teeth of the drive gear. The platform may be flat and may be positioned between guidewalls of a slotted mounting block that defines tracks upon which the platform may slide or roll mounted upon rollers. The slotted mounting block defines a cavity between the opposing guidewalls. A first and second target, preferably made of a metallic material, is disposed on opposite ends of the flat platform, thereby to extend into the cavity. A first and second proximity sensor is mounted within the slotted mounting block, thereby to extend into the cavity proximate to the first and second targets, respectively. In a preferred embodiment, the position of the first and second targets is adjustable along a length of the flat platform. In a preferred embodiment, the proximity sensors are eddy current devices that undergo a change in electrical current in response to the proximity of a metal object in relation to the sensor. The proximity sensor causes the current to increase when metal is in close proximity to the sensor. Indicator means, such as a terminal board for instance, is operatively connected to the first and second proximity sensors, thereby to receive as input certain output signals from the proximity sensors. The output signals are indicative of the respective positions of the first and second targets, thereby being indicative of the associated platform, point detector connecting rod, and switch points.

In another preferred embodiment of the present invention, the point detector connecting rod is mounted directly to the slidable flat platform, such that the lateral movement of the point detector connecting rod directly slides or rolls the flat platform along the tracks provided by the sliding mounting block with no translation of rotational to lateral movement from a drive shaft of the slidable flat platform. In this preferred embodiment, guide rollers may be mounted upon axles connected to the flat platform, thereby to minimize friction of the flat platform moving laterally within the tracks of the slotted mounting blocks. Additional guide rollers may be mounted perpendicularly to the lateral rollers such that the guide rollers roll along the side surface of the guide walls, thereby to minimize friction of the flat platform along the guide walls. In this preferred embodiment, opposing edges of the flat platform, preferably a metallic material, function as the first and second targets that may be sensed by proximity sensors. The proximity sensors are fixedly mounted through the slotted mounting block, extending into the cavity and beneath the targets of the flat platform. The proximity sensors are fixedly mounted to an adjustable sensor mount provided on each end of the cavity, such that the first and second proximity sensor may be adjustably moved laterally toward or away from the opposing sensor.

In accordance with a preferred embodiment of the present invention, a railway switch circuit controller is provided for a railroad switch point that is movable by an attached point detector connecting rod translated by a switching device, wherein the railway switch circuit controller comprises: a housing; a shaft rotatably disposed within the housing and rotatably attached to the point detector connecting rod, whereby lateral movement of the point detector connecting rod rotates the shaft; platform means cooperatively engaged with the shaft for translating rotational movement of the shaft into lateral movement of the platform means; a first and second proximity detector mounted within the housing and proximate to the platform means, for providing a first and second output indicative of the position of the platform means and the point detector connecting rod; and indicator means operatively connected to the first and second proximity detectors for receiving as inputs the first and second outputs, whereby the indicator means provides and indication of the platform means and the point detector connecting rod. An advantage of the present invention is that the circuit controller is adjustable externally, typically requiring an open end wrench, a socket wrench, and a screw driver, thereby reducing the risk of damage to the internal parts or connections due to repeated entry into the housing.

An advantage of the present invention is that the circuit controller is adjustable externally, typically requiring an open end wrench, a socket wrench, and a screwdriver, thereby reducing the risk of damage to the internal parts or connections due to repeated entry into the housing.

Another advantage of the present invention is that moving parts are minimized, thereby significantly reducing wear and tear and reducing time between required maintenance.

Another advantage of the present invention is that an improved circuit controller housing mounting configuration will be directly interchangeable with current designs of external tie-mounted circuit controllers, particularly by mounting the improved circuit controller with bolts in existing bolt holes of prior art circuit controllers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
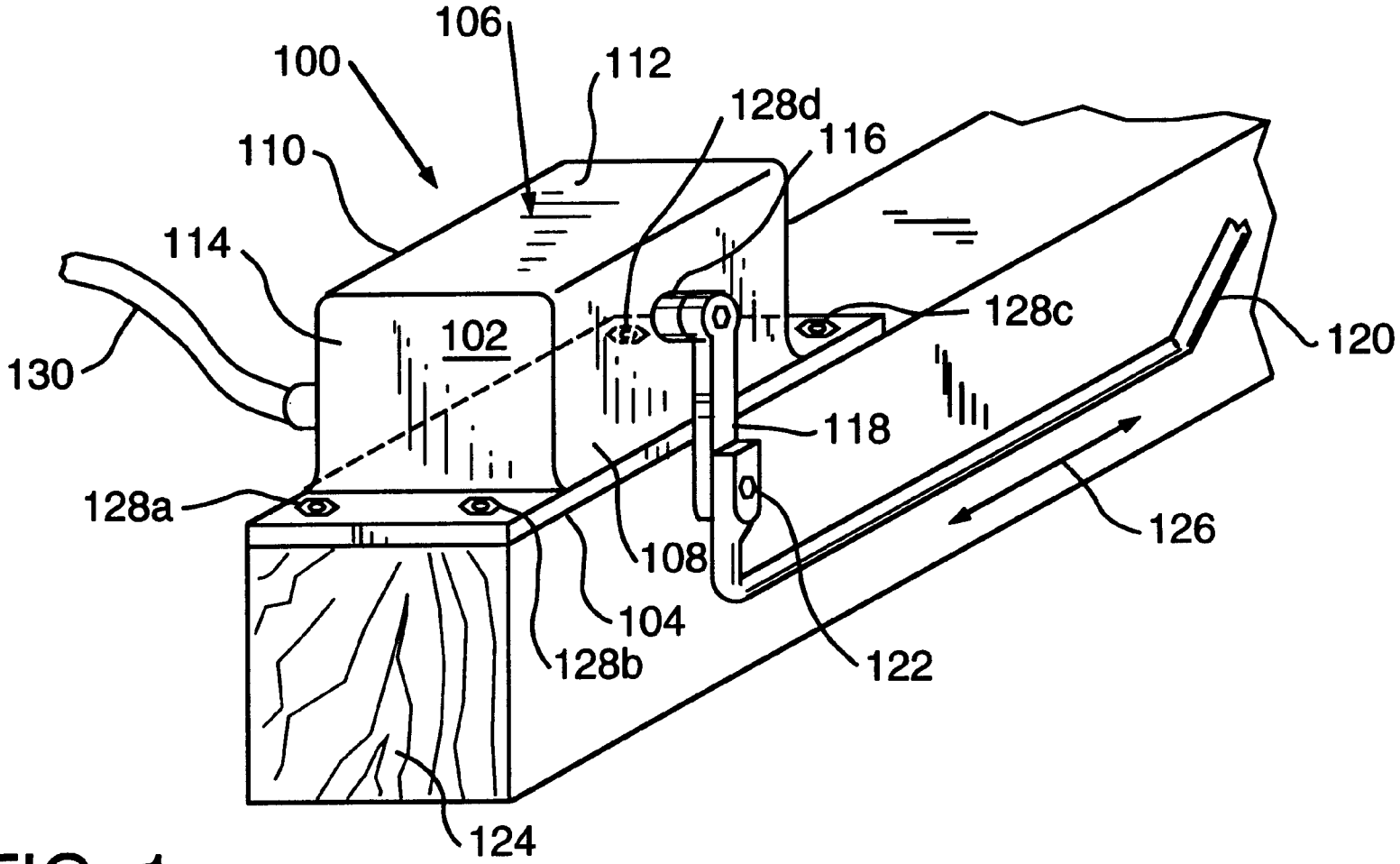
FIG. 1 is a top perspective view of a first preferred embodiment of a railway switch circuit controller operated with a rotational crank and mounted atop a railway tie in accordance with the present invention.

Referring now to the drawings in detail, FIG. 1 shows a top perspective view of a railway switch circuit controller 100 in accordance with a preferred embodiment of the present invention, having a housing 102 with a bottom surface 104, a top surface 106, opposing side surfaces 108, 110, and opposing end surfaces 112, 114. A shaft 116 is rotatably disposed through the side surfaces 108, 110. As is known in the art, a crank arm 118 may be connected to the shaft 116 and a point detector connecting rod 120 may be connected to the crank arm 118 with a connector 122, such as a known clamp assembly, for instance, thereby to partially rotate the shaft 116 when the point detector connecting rod 120 is moved laterally in a direction which is parallel to a railroad tie 124, as shown by an arrow 126.

One skilled in the art will recognize that attaching the connecting rod 120 below the shaft 116, as shown in FIG. 1, will rotate the shaft 116 in a first rotational direction when the rod 120 is moved laterally in a first lateral direction, whereas attaching the connecting rod 120 above the shaft 116 will rotate the shaft 116 in a second rotational direction which opposes the first rotational direction when the rod 120 is moved laterally in the first lateral direction.

The controller 100 may be affixed atop the railroad tie 124 with bolts 128*a*, 128*b*, 128*c*, 128*d* (shown in phantom) as is known in the art. The controller 100 of the present invention may be interchangeable with and thereby replace a previously mounted similar controller by mounting bolts 128*a*, 128*b*, 128*c*, 128*d* into known bolt holes that may already exist in the railroad tie 124 from the previously mounted similar controller. A wire lead 130 may extend from the controller 100.

Figure 2:
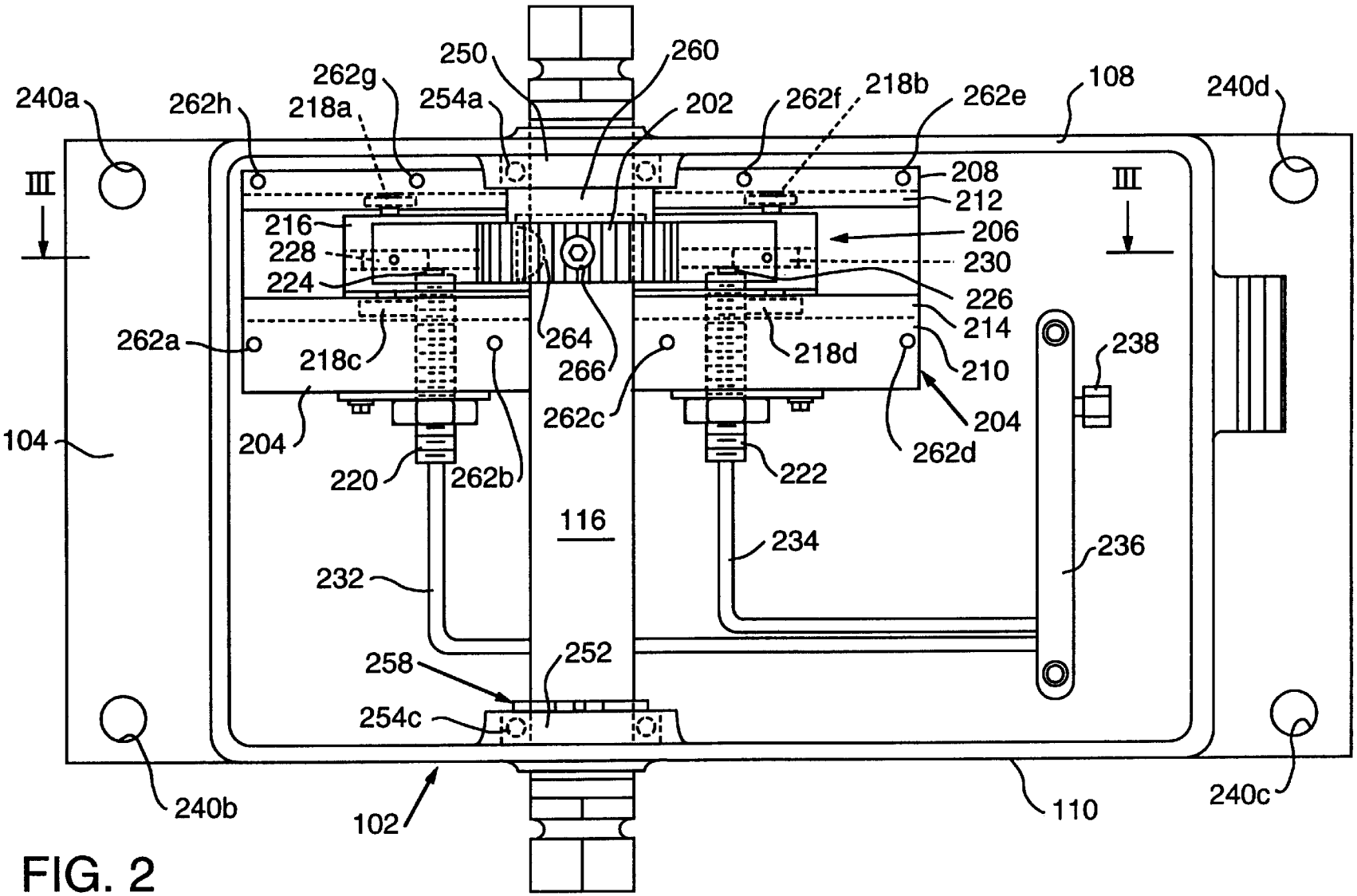
FIG. 2 is a top plan view of FIG. 1 taken in partial cross section in accordance with a preferred embodiment of the present invention.

FIG. 2 is a top plan view of FIG. 1 taken in partial cross-section of the controller 100. As previously described, the shaft 116 is rotatably disposed through the side surface 108, 110 of the housing 102. To enhance support and rotation of the shaft, the shaft 116 may rotate within collars 250, 252 that are affixed to the interior of the side surfaces 108, 110, respectively. In a preferred embodiment, ball bearings 254*a*, 254*c* (shown in phantom) may be disposed within the collars 250, 252, respectively, thereby to rotate within the collars with the rotation of the shaft 116, thereby to minimize friction of the shaft 116 within the collars 250, 252, as is known in the art. A snap rings 258 affixed to the collar 252 may retain the shaft 116 within the collars 250, 252.

A drive gear 202 is fixedly mounted to the shaft 116 to rotate therewith. As known in the art, a woodrift key 264 (shown in phantom) may extend from the drive gear 202 and partially into the shaft 116 to maintain a direct relationship between the rotation of the drive gear 202 and the shaft 116. (Refer also to FIG. 3) Further, a set screw 266 may extend through the drive gear 202 and partially into the shaft 116 to maintain a direct relationship between the rotation of the drive gear 202 and the shaft 116. (See also phantom set screw 266 in FIG. 3.)

A spacer 260 may be disposed between the collar 250 and the snap ring 256, thereby to distance the drive gear 202 from the collar 250. A mounting block 204 is affixed to the housing 102. In a preferred embodiment, the mounting block is affixed to the bottom surface 104 with affixing means, such as screws 262*a*, 262*b*, 262*c*, 262*d*, 262*e*, 262*f*, 262*g*, 262*h*. One skilled in the art will understand that similar affixing means, such as glue or spot welds, for instance, may be used.

The mounting block 204 may be slotted, thereby to define a cavity 206 between a first guide wall 208 and a second guide wall 210, each of which guide walls define a track 212, 214 respectively. In a preferred embodiment of the present invention, a platform 216 has bearings 218*a*, 218*b*, 218*c*, 218*d*, which bearings are mounted to support the platform 216 above the cavity 206, and which bearings ride upon the tracks 212, 214 as shown, thereby to permit lateral movement of the platform 216 between the guidewalls 208 and 210. In a preferred embodiment, the bearings may be provided with ball bearings (not shown) about the axles to minimize friction and related wear and tear.

A first proximity sensor 220 and a second proximity sensor 222 is mounted to the mounting block 204 through the guide wall 210, such that a sensor end 224, 226 of each respective sensor 220, 222 extends into the cavity 206 and beneath the platform 216. A first target 228 and a second target 230 extend from opposing ends of the platform 216 and into the cavity 206 proximate to the proximity sensors 220, 222, respectively, thereby to be sensed by each respective sensor as the targets 228, 230 are moved laterally with the platform 206. In a preferred embodiment of the invention, the targets 228, 230 are manufactured of a metallic material, and the proximity sensors 220, 222 are eddy current devices which undergo a change in electrical current in response to the proximity of the metallic targets 228, 230 in relation to the respective sensors 220, 222.

In the present invention, the electrical current produced by the proximity sensor 220 is affected by the location of the first target 228. Likewise, the electrical current produced by the proximity sensor 222 is affected by the location of the second target 230. Thus, the amount of current within the sensors 220, 222 is an indication of the respective targets 228, 230 that are moved laterally when the platform 216 is urged laterally by the engaged cooperation of teeth 302 of the drive gear 202 with teeth 304 of the platform 216 (refer to FIG. 3).

Respective wire leads 232, 234 electrically connect the proximity sensors 220, 222 to indicator means, such as a terminal board 236, for instance. The terminal board 236 has an terminal stud 238 for connection of the terminal board to external devices (not shown), such as a PLC, which may be used in a checked redundant configuration for the targets 228, 230 and the point detector connecting rod 120, for instance. The bottom surface of the housing 102 defines bolt holes 240*a*, 240*b*, 240*c*, 240*d*, for respective bolts 128.

Figure 3:
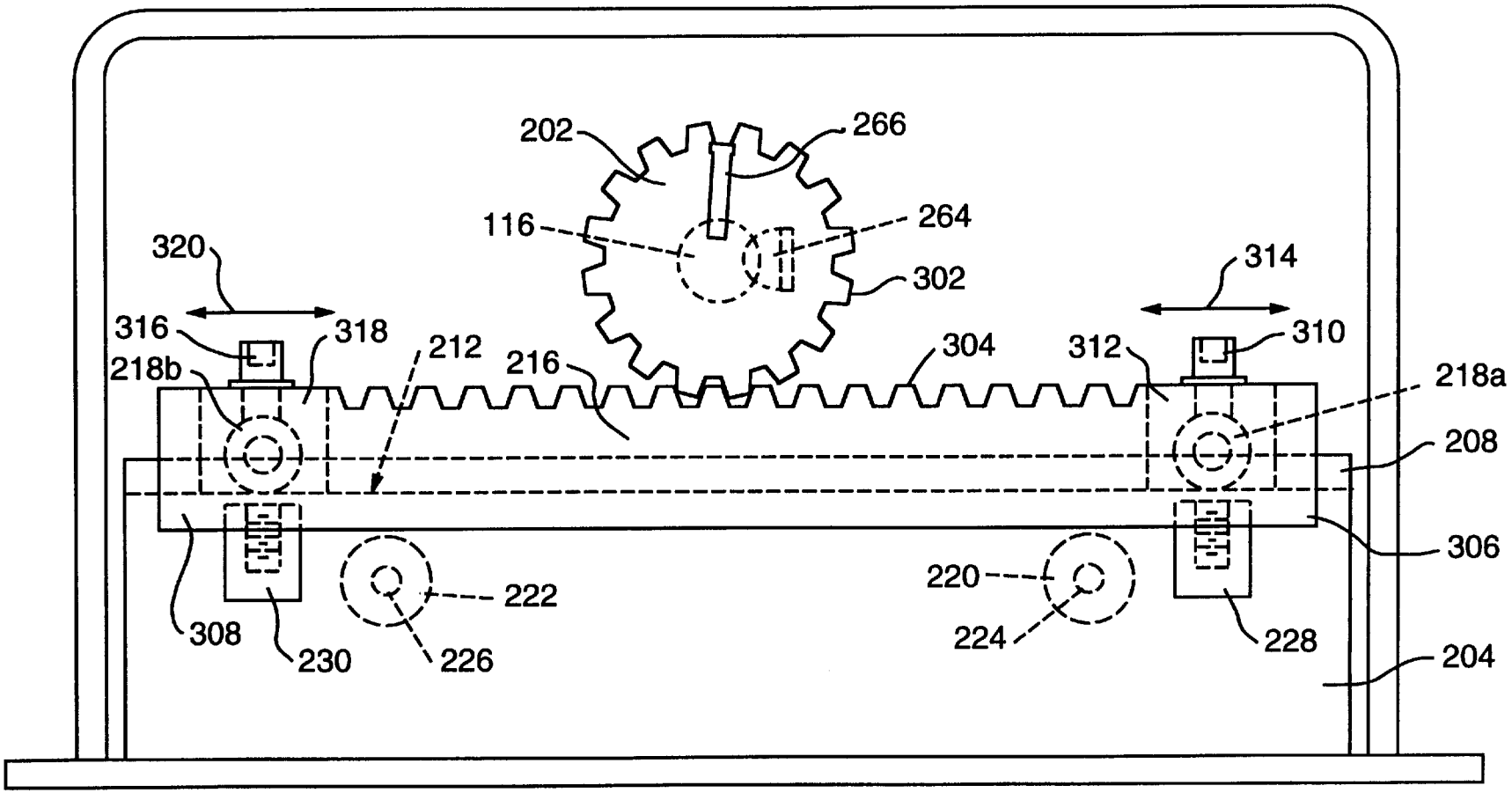
FIG. 3 is a side elevational view of the toothed drive gear; and toothed platform taken along the lines III—III of FIG. 2.

FIG. 3 is a side view of the present invention shown in FIG. 2 taken along the lines III—III. Mounting block 204 is affixed to the bottom surface 104 with affixing means, as described hereinabove. Bearings 218*a*, 218*b* (shown in phantom), which are mounted to the platform 216 in a manner known in the art, ride upon the track 212 (shown in phantom), which track 212 is defined by the guide wall 208 of the mounting block 204. The platform 216 has teeth 304 that cooperatively engage with the teeth 302 of the drive gear 202, thereby to translate rotational movement of the shaft 116 to lateral movement of the platform 216 within the tracks 212, 214 upon the bearings 218*a*, 218*b*, 218*c*, 218*d* (refer to FIG. 2). It will be understood that similar means of translating rotational movement of the shaft 116 to lateral movement of the platform 216 may be used, such as a rubber bearing or wheel in contact with a flat or ridged platform (not shown), for instance.

The first target 228 is centrally affixed to a first end 306 of the platform 216 and the second target 230 is similarly mounted to the second end 308 of platform 216 (see FIG. 2). In a preferred embodiment, the first target 228 is adjustably affixed to the platform 216 by means of a retaining bolt 310 that extends through a slot 312 that is defined in the first end 306 of the platform 216, whereby the retaining bolt 310 may be loosened to slide the retaining bolt 310 and the attached first target 228 in either direction defined by the bi-directional arrow 314. Likewise, the second target 230 is mounted to the platform 216 by means of a retaining bolt 316 that extends through a slot 318 that is defined in the second end 308 of the platform 216. The second target 230 may be adjustable by loosening the retaining bolt 316 and sliding the bolt 316 with the attached target 230 in either direction, shown by the bidirectional arrow 320.

It will be understood that the targets 228, 230 may be adjustable to accommodate different positions of the proximity sensors 220, 222 that may be found in varying circuit controllers. The targets 228, 230 may be adjustable such that when the target 228 is in line to be sensed by the proximity sensor 220 (shown in phantom), then the second target 230 will not be in line to be sensed by the proximity sensor 222 (shown in phantom). Likewise, the second target 230 may be adjustable such that when the second target 230 is in line to be sensed by the proximity sensor 222, then the first target 228 will not be in line to be sensed by the proximity sensor 220.

Figure 4:
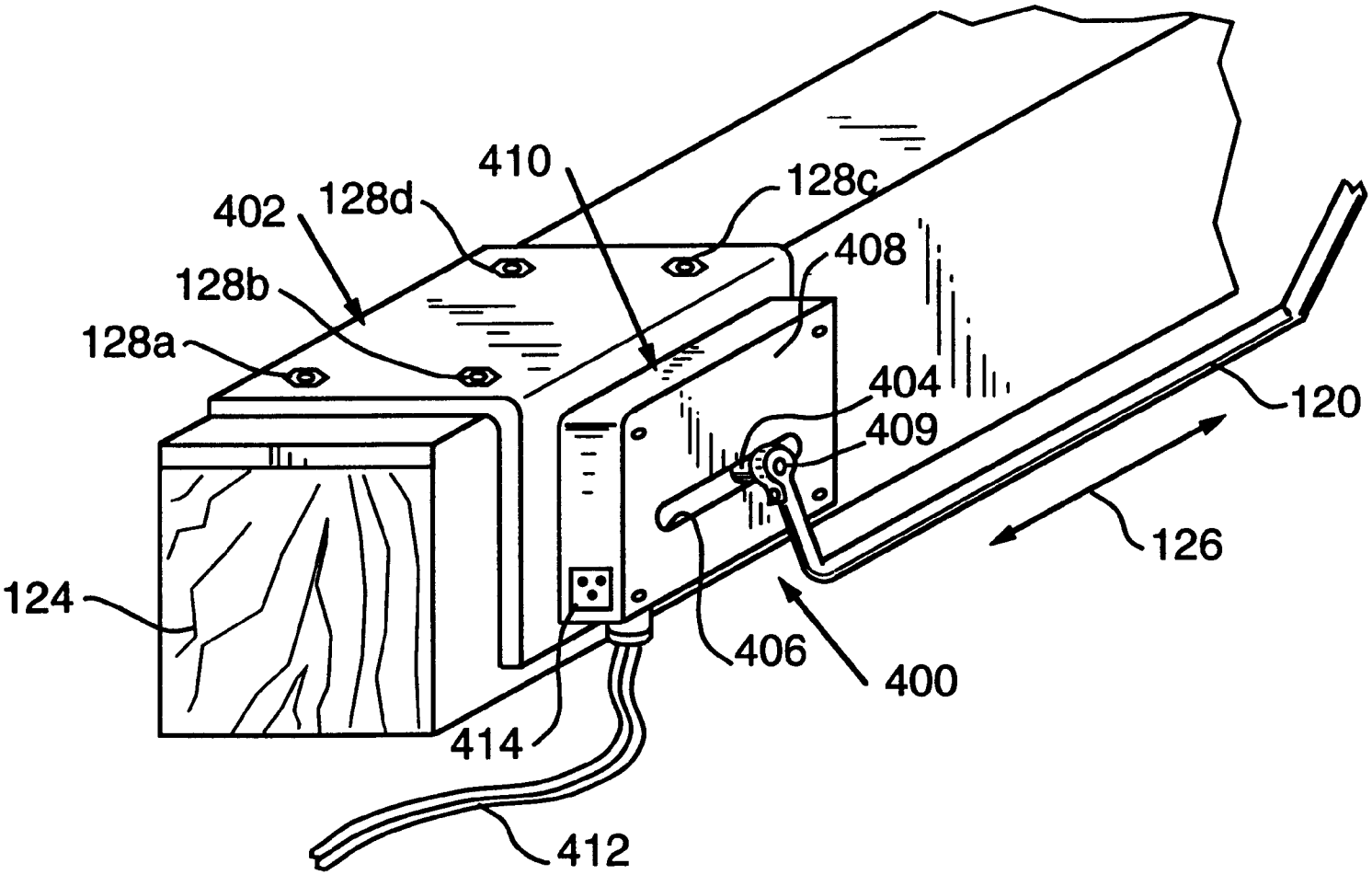
FIG. 4 is a top perspective view of another preferred embodiment of the present invention mounted along the side of a railway tie.

FIG. 4 shows a side perspective view of a second preferred embodiment of the present invention wherein the railway switch circuit controller 400 is mounted on the side of the railroad tie 124, typically with an L-bracket 402. The L-bracket 402 may be secured with the bolts 128*a*, 128*b*, 128*c*, 128*d* that may extend through the L-bracket 402 and into known bolt holes that may already exist in the railroad tie 124 from a previous similar circuit controller being replaced by the present invention. A shaft 404 is slidable within a slot 406 defined in a sidewall 408 of the housing 410. The shaft 404 may be connected to the point detector connecting rod 120 with a clamp 409. The rod 120 and the shaft 404 may be movable as shown by the bi-directional arrow 126 in a manner similar to that described for the preferred embodiment above FIG. 1. A wire lead 412 may extend from the controller 400. The controller 400 may be adjustable externally without removing the housing 102 by means of an adjustment access 414 through which an open end wrench, a socket wrench, or a screwdriver may be inserted, thereby reducing the risk of damage to the internal parts or connections due to repeated entry into the housing 102.

Figure 5:
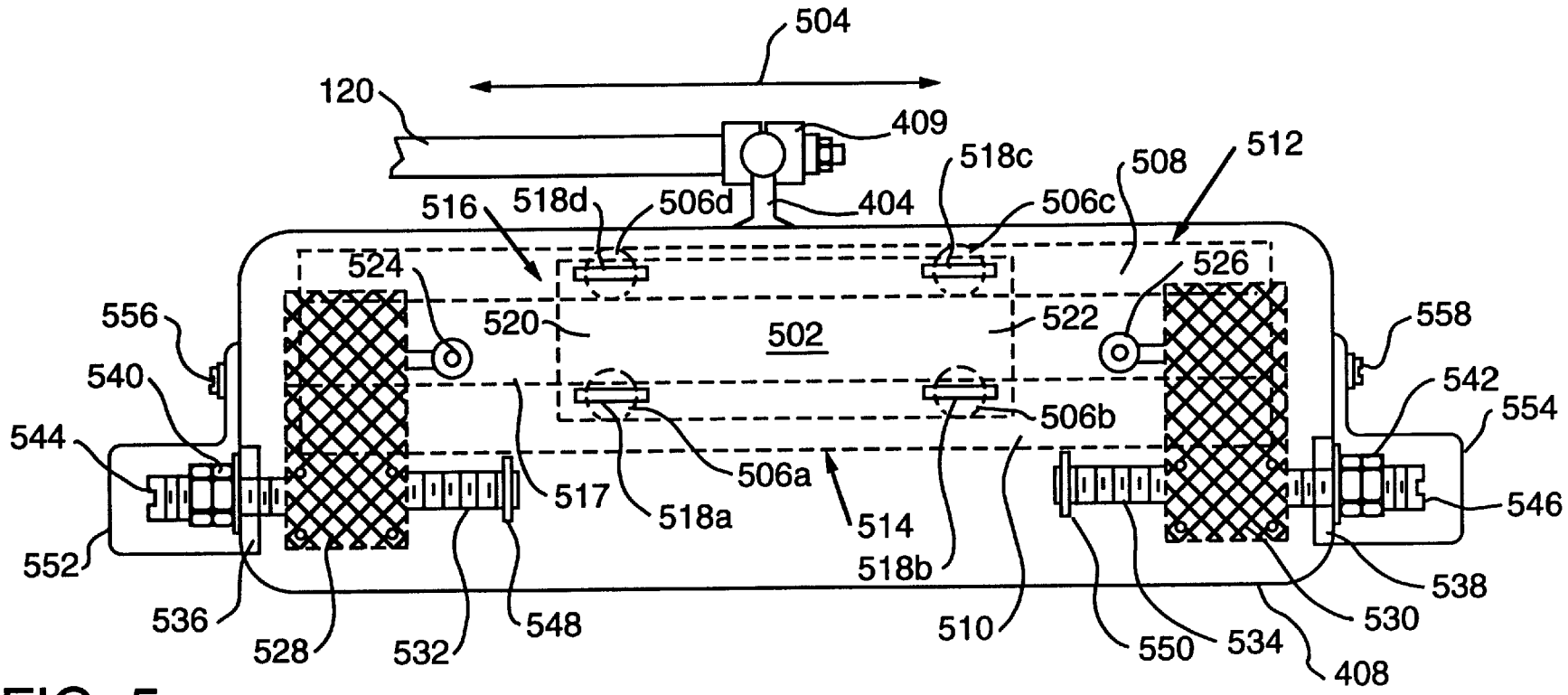
FIG. 5 is a top cutaway view of the preferred embodiment of FIG. 4.

FIG. 5 shows a top view of the present invention shown in FIG. 4. The point detector connecting rod 120 is attached with the clamp 409 to the shaft 404, which shaft is attached to the platform 502. Lateral movement of the point detector connecting rod 120 and the attached shaft 404 in either direction shown by the bi-directional arrow 504 thereby moves the platform 502 in the same direction. Similarly to the platform 216 of FIGS. 1–3, the platform 502 may ride upon mounted lateral rollers 506*a*, 506*b*, 506*c*, 506*d* within tracks 508, 510. The tracks 508, 510 respectively may be defined by guidewalls 512, 514 of a mounting block 516. The mounting block 516 may define a cavity 517. The mounting block 516 is affixed to the housing 410 in a manner similar to that described for the mounting block 204 of FIGS. 1–3. In a preferred embodiment, guide rollers 518*a*, 518*b*, 518*c*, 518*d* are mounted to the platform 502 substantially perpendicular to the mounted lateral rollers 506*a*, 506*b*, 506*c*, 506*d*, respectively, thereby to ride along and to minimize friction and wear and tear along the inner surfaces of the guidewalls 512, 514. Ball bearings (not shown) may be provided about the axles (not shown) of the lateral rollers 506*a*, 506*b*, 506*c*, 506*d* and the guide rollers 518*a*, 518*b*, 518*c*, 518*d*, thereby to minimize friction and wear and tear at the axles of the rollers.

In this preferred embodiment, a first edge 520 and a second edge 522 of the platform 502, preferably made of a metallic material, provide moving targets that are respectively sensed by a proximity sensor 524, 526. The proximity sensors 524, 526 may be mounted upon sensor mounts 528, 530, respectively. The sensor mounts 528, 530 may be mounted upon threaded adjusters 532, 534, respectively, thereby to be laterally movable within the housing 410. The threaded adjusters 532, 534 may be a threaded bolt, for instance. The threaded adjuster 532, 534 may be mounted through respective retainers 536, 538 in the housing 408, with nut-and-washer combinations 540, 542, in a manner known in the art, such that rotation of slotted bolt head 544, 546, respectively, drives the sensor mount 528, 530, respectively, laterally along respective threaded adjuster 532, 534. Lateral movement of the sensor mount 528, 530, respectively moves the proximity sensor 524, 526 laterally with respect to the platform 502. The threaded adjuster may be equipped with a stop 548, 550, thereby to keep respective sensor mounts 528, 530 from being moved off of respective threaded adjusters 532, 534. A protective cover 552, 554, may be provided over the slotted bolt head 544, 546, respectively, and affixed to the housing 408 with respective connectors 556, 558, such as a threaded bolt, for instance.

2. Operation of the Preferred Embodiment

In operation, lateral movement of the point detector connecting rod 120 translates into rotational movement of the shaft 116 and the drive gear 202. The operation will be described for the preferred embodiment having the connecting rod 120 attached below the shaft 116, as shown in FIG. 1. Referring to FIG. 3, lateral movement of the rod 120 in a first lateral direction from the proximity sensor 222 to the proximity sensor 220 translates into rotational movement of the shaft 116 and the drive gear 202 in a first rotational direction that is counter-clockwise as viewed in FIG. 3. Rotational movement of the shaft 116 and the drive gear 202 in the first rotational direction translates into lateral movement of the platform 216 in the first lateral direction, resulting from the urging of teeth 302 of the drive gear 202 against the cooperatively engaged teeth 304 of the platform 216.

As described in the detailed description of FIG. 1, one skilled in the art will recognize that when the connecting rod 120 is attached above the shaft 116 and is moved in the first lateral direction, the platform 216 will be moved in a second lateral direction that is clockwise as viewed in FIG. 3, thereby urging the platform 216 in a second lateral direction from the proximity sensor 220 to the proximity sensor 222, which second lateral direction is opposite the first lateral direction.

As the platform 216 moves laterally in the first lateral direction along the tracks 212, 214, the target 228 is moved away from the sensor end 224 while the target 230 is moved closer to the sensor end 226, thereby decreasing the eddy current sensed by the proximity sensor 220 and transmitted via wire lead 232 to the terminal board 236, while simultaneously increasing the eddy current sensed by the proximity sensor 222 and transmitted via wire lead 234 to the terminal board 236 (refer to FIG. 2). Similarly, lateral movement of the point detector connecting rod 120 in the second direction which opposes the first direction will rotate the shaft 116 and drive gear 202 in an opposing direction, thereby moving the platform in an opposing direction, which will increase the eddy current sensed by the sensor end 224 of the proximity sensor 220 and decrease the eddy current sensed by the sensor end 226 of the proximity sensor 222.

The terminal board is connected to indicator means (not shown), such as a microprocessor-controlled display (not shown), which indicator means converts the current sensed from the sensors into the required position measurement, which may be a measurement of distance that the point detector connecting rod has moved. Thus, the indicator means indicates to the operator the relative position of the point detector connecting rod 120 and associated switch points. For example, in a normal position (not shown), one sensor would have a maximum current value while the opposite sensor would have a minimum current value, thereby indicating that the railway switch is in the normal position. Conversely, in a reverse position (not shown), the sensors would have opposite current levels, indicating that the railway switch is in the reverse position.

The microprocessor may also test whether or not the sensors are operating correctly, and thus provide assurance that the proximity sensors 220, 222 are operating correctly and are indicating the actual position of the point detector connecting rod 120 and associated switch points. The current outputs from the respective sensors 220, 222 will change as the shaft 116 is rotated between normal and reverse positions.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A railway switch circuit controller for a railroad switch point that is movable by an attached point detector connecting rod, wherein the railway switch circuit controller comprises:

a controller housing having a bottom surface and opposed side surfaces, wherein said side surfaces have respective openings provided therethrough;

a shaft rotatably disposed through said side surface openings and coupled to the point detector connecting rod, thereby to be rotated by lateral movement thereof;

a drive gear fixedly mounted to said shaft to rotate with said shaft;

a mounting block defining a cavity between opposing guide walls and affixed proximate to said drive gear within said housing;

a platform cooperatively engaged with said drive gear and positioned between said opposing guide walls, thereby to be movable laterally over said cavity according to rotation of said drive gear;

a first and second target fixedly mounted to said platform and extending into said cavity;

a first and second proximity detector mounted to said mounting block and extending into said cavity, for providing a first and second output, respectively, indicative of the respective positions of said first and second targets within said cavity; and a terminal board operatively connected to said first and second proximity detectors and receiving as input said first and second outputs, whereby said terminal board provides an indication of the position of the point detector connecting rod and attached switch point.

2. The railway switch circuit controller according to claim 1, wherein said first and second proximity detector is enclosed within said controller housing.

3. The railway switch circuit controller according to claim 2, wherein said first and second proximity detector is comprised of a first and second eddy current sensor, respectively.

4. The railway switch circuit controller according to claim 3, wherein said first and second eddy current sensor is operatively associated with said first and second target, respectively.

5. The railway switch circuit controller according to claim 4, wherein said first and second target is adjustably movable upon said platform.

6. The railway switch circuit controller according to claim 4, wherein said first and second eddy current sensor is adjustably movable within said housing.

7. The railway switch circuit controller according to claim 5, wherein said first output comprises a first electrical current having a first maximum current value and a first minimum current value, and said second output comprises a second electrical current having a second maximum current value and a second minimum current value.

8. The railway switch circuit controller according to claim 6, wherein said first output comprises a first electrical current having a first maximum current value and a first minimum current value, and said second output comprises a second electrical current having a second maximum current value and a second minimum current value.

9. The railway switch circuit controller according to claim 7, further comprising teeth in said platform, wherein said teeth cooperatively engage said drive gear to move said platform when said drive gear is rotated.

10. The railway switch circuit controller according to claim 8, further comprising teeth in said platform, wherein said teeth cooperatively engage said drive gear to move said platform when said drive gear is rotated.

11. A railway switch circuit controller for a railroad switch point that is movable by an attached point detector connecting rod translated by a switching device, wherein the railway switch circuit controller comprises:

a housing;

a shaft rotatably disposed within said housing and rotatably attached to the point detector connecting rod, whereby lateral movement of the point detector connecting rod rotates said shaft;

platform means cooperatively engaged with said shaft for translating rotational movement of said shaft into lateral movement of said platform means;

a first and second proximity detector mounted within said housing and proximate to said platform means, for providing a first and second output indicative of the position of said platform means and the point detector connecting rod; and indicator means operatively connected to said first and second proximity detectors for receiving as inputs said first and second outputs, whereby said indicator means provides and indication of said platform means and the point detector connecting rod.

12. The railway switch circuit controller according to claim 11, wherein said first and second proximity detectors are fixedly mounted within said housing.

13. The railway switch circuit controller according to claim 11, wherein said first and second proximity detectors are adjustably mounted within said housing.

14. The railway switch circuit controller according to claim 12, wherein said first and second proximity detectors are each comprised of eddy current sensors.

15. The railway switch circuit controller according to claim 13, wherein said first and second proximity detectors are each comprised of eddy current sensors.

16. The railway switch circuit controller according to claim 12, whereby lateral movement of the point detector connecting rod in a first lateral direction results in lateral movement of said platform means in a second lateral direction which is opposite said first lateral direction.

17. The railway switch circuit controller according to claim 13, whereby lateral movement of the point detector connecting rod in a first lateral direction results in lateral movement of said platform means in a second lateral direction which is opposite said first lateral direction.

18. The railway switch circuit controller according to claim 12, whereby lateral movement of the point detector connecting rod in a first lateral direction results in lateral movement of said platform means in said first lateral direction.

19. The railway switch circuit controller according to claim 13, whereby lateral movement of the point detector connecting rod in a first lateral direction results in lateral movement of said platform means in said first lateral direction.

20. The railway switch circuit controller according to claim 12, further comprising:

a first and second target that are both movable with said platform means, wherein said first target is operatively associated with said first proximity detector and said second target is operatively associated with said second proximity detector.

21. The railway switch circuit controller according to claim 20, wherein said first and second target is adjustably attached to said platform means.

22. The railway switch circuit controller according to claim 21, wherein said first output comprises a first electrical current having a first maximum current value and a first minimum current value, and said second output comprises a second electrical current having a second maximum current value and a second minimum current value.

23. The railway switch circuit controller according to claim 13, wherein said first output comprises a first electrical current having a first maximum current value and a first minimum current value, and said second output comprises a second electrical current having a second maximum current value and a second minimum current value.

24. A method of providing a fail-safe signal that indicates the position of a point detector connecting rod connected to a railway switch circuit controller, wherein the method comprises the steps of:

a) laterally moving the point detector connecting rod external to a housing such that a movable platform is moved laterally internal to said housing;

b) sensing the position of said movable platform within said housing with a first and second proximity detector mounted within said housing and proximate to said platform means;

c) transmitting by said first and second proximity detectors respective first and second outputs that are indicative of the position of said platform means and the point detector connecting rod; and d) receiving said first and second outputs by indicator means for interpreting said first and second outputs, thereby to provide an indication of the position of the point detector connecting rod.

25. The method according to claim 24, wherein said first and second proximity detectors are fixedly mounted within said housing.

26. The method according to claim 24, wherein said first and second proximity detectors are adjustably mounted within said housing.

* * * * *